US009227759B2

(12) United States Patent
Kurihara

(10) Patent No.: US 9,227,759 B2
(45) Date of Patent: Jan. 5, 2016

(54) SYNTHETIC RESIN BOTTLE

(75) Inventor: Goro Kurihara, Koto-ku (JP)

(73) Assignee: YOSHINO KOGYOSHO CO., LTD., Tokyo (JP)

( * ) Notice: Subject to any disclaimer, the term of this patent is extended or adjusted under 35 U.S.C. 154(b) by 0 days.

(21) Appl. No.: 13/819,832

(22) PCT Filed: Aug. 2, 2011

(86) PCT No.: PCT/JP2011/067641

§ 371 (c)(1),
(2), (4) Date: Mar. 18, 2013

(87) PCT Pub. No.: WO2012/029487

PCT Pub. Date: Mar. 8, 2012

(65) Prior Publication Data

US 2013/0180943 A1 Jul. 18, 2013

(30) Foreign Application Priority Data

Aug. 31, 2010 (JP) ..... 2010-194003

(51) Int. Cl.
*B65D 1/02* (2006.01)
*B65D 79/00* (2006.01)
*B65D 23/00* (2006.01)

(52) U.S. Cl.
CPC ..... *B65D 23/001* (2013.01); *B65D 1/0261* (2013.01); *B65D 1/0276* (2013.01); *B65D 79/005* (2013.01)

(58) Field of Classification Search
USPC ..... 220/609, 608, 606, 635, 636; 215/371, 215/372, 373, 376
See application file for complete search history.

(56) References Cited

U.S. PATENT DOCUMENTS

| | | | | |
|---|---|---|---|---|
| 4,108,324 | A | 8/1978 | Krishnakumar et al. | |
| 6,595,380 | B2 * | 7/2003 | Silvers | 215/373 |
| 2009/0090728 | A1 * | 4/2009 | Trude et al. | 220/609 |
| 2009/0242575 | A1 * | 10/2009 | Kamineni et al. | 220/608 |
| 2010/0219152 | A1 * | 9/2010 | Derrien et al. | 215/374 |

FOREIGN PATENT DOCUMENTS

| | | |
|---|---|---|
| JP | B2-57-57330 | 12/1982 |
| JP | A-8-48322 | 2/1996 |
| JP | A-2007-269392 | 10/2007 |

OTHER PUBLICATIONS

Sep. 13, 2011 Written Opinion of the International Searching Authority issued in International Application No. PCT/JP2011/067641 (with translation).
Sep. 13, 2011 International Search Report issued in International Application No. PCT/JP2011/067641 (with translation).

* cited by examiner

*Primary Examiner* — Fenn Mathew
*Assistant Examiner* — Jennifer Castriotta
(74) *Attorney, Agent, or Firm* — Oliff PLC

(57) ABSTRACT

A biaxially stretched, blow molded synthetic resin bottle has a bottom including a sunken bottom portion, and deforms as it draws upward in a direction of the bottle inside and includes a ring groove formed by being successively connected to an inner peripheral edge of a ground contact portion disposed at the foot of an outer peripheral wall of the bottom, a central concave portion disposed at a center of the bottom, and a flat ring portion disposed between an inner peripheral edge of the ring groove and the central concave portion, wherein the sunken bottom portion includes a plurality of short slim ribs disposed at several points of the flat ring portion.

8 Claims, 3 Drawing Sheets

PRIOR ART

SYNTHETIC RESIN BOTTLE

TECHNICAL FIELD

This invention relates to a synthetic resin bottle, especially to the one provided with a body having high shape-retainability and with a bottom allowing reduced pressure to be absorbed by the deformation of a bottom plate, which draws upward when the pressure drops inside the bottle.

BACKGROUND ART

Biaxially stretched and blow-molded bottles made of polyethylene terephthalate (hereinafter referred to as "PET"), the so-called PET bottles, have high levels of transparency, mechanical strength, heat resistance, and gas barrier property, and up to now, have been in wide use as the containers for various beverages. Conventionally, what is called hot filling is utilized as a method of filling the PET bottles with content fluids, e.g., juices, teas, and the like, which require pasteurization. This involves filling the bottle with a content fluid at a temperature of about 90 degrees C., sealing the bottle with a cap, and cooling the bottle. This process causes the pressure inside the bottle to decrease considerably.

As regards the application of use involving hot filling described above, Patent Document D1, for example, teaches that the body is provided with the so-called vacuum absorbing panels, which are, by design, easily deformed into a dented state under a reduced pressure condition. At the time of a decrease in internal pressure, these vacuum absorbing panels perform a vacuum absorbing function by deforming into the dented state, thus allowing the bottle to retain good shape while ensuring that the portions of the bottle other than the vacuum absorbing panels have rigidity enough to avoid troubles on the bottle conveyor lines, during storage in piles, and inside the automatic vending machines.

On the other hand, in some cases it is necessary to avoid forming the vacuum absorbing panels on the body out of regard for the design of bottle appearance. Since the vacuum absorbing panels tend to be subject to flexural deformation, it is also necessary for body walls to have high surface rigidity to give the body high shape retainability enough to be able to stack the bottles on their sides inside the vending machines. For these applications of use, Patent Document D2, for example, shows a synthetic resin bottle which has no vacuum absorbing panel in the body wall, but in which the vacuum absorbing function is performed by the upward drawing deformation of a bottom plate. Especially in the cases of small-size bottles with a capacity of 500 ml, 350 ml or 280 ml, the vacuum absorbing panels disposed in the body wall would have a limited panel area. In that case, it would be difficult to fully satisfy both of the vacuum-absorbing function and the rigidity or buckling strength of the body. Therefore, the vacuum-absorbing function need be performed by the deformation of bottom plate as described above.

As an example, FIG. 4 shows a bottle 101 in which the vacuum absorbing function is performed by a bottom plate of a bottom 105, which plate deforms so as to draw upward. FIG. 4(*a*) is a front view; and FIG. 4(*b*) is a bottom view. The bottle 101 comprises a body 104 having a thick wall and peripheral groove ribs 107 to give high surface rigidity and high buckling strength to the body 104.

The bottom 105 comprises a ground contact portion 116 disposed at the foot of an outermost peripheral wall and successively connected to the body 104, a ring groove 115 disposed on the inside of the ground contact portion 116, a flat ring portion 113 disposed on the inside of, and integrally connected to, the ring groove 115, and a central concave portion 112 disposed at a center of the bottom 105 and successively connected to the flat ring portion 113. When there is a decrease in the pressure inside the bottle 101, the body 104 keeps its shape, but the ring groove 115 deforms starting from the base of an inner peripheral wall of the ground contact portion 116. Then, the flat ring portion 113 and the central concave portion 112 draw upward (i.e., they deform in the arrowed direction in FIG. 4(*a*)) so that the bottle performs the vacuum absorbing function.

PRIOR ART REFERENCES

Patent Documents

Japanese patent publication number H08-048322
Japanese patent publication number 2007-269392

SUMMARY OF THE INVENTION

Problems to be Solved by the Invention

However, even for the bottle 101 of the type shown in FIG. 4, thin wall is increasingly in demand from points of view of resource saving and cost reduction. If the drawing-upward deformation further proceeds in the bottom 105 under a reduced pressure condition and in a situation where bottle wall has become increasingly thinner, then tiny, unintended foldlines D may develop at several points in the corners that form the boundaries between an inner peripheral edge of the ring groove 115 and an outer peripheral edge of the flat ring portion 113, as shown in the bottom view of FIG. 4(*b*). These foldlines D inhibit the central concave portion 112 from further drawing upward. Thus, they disturb the smooth deforming movements, and as a result, cause a problem of an unsatisfactory vacuum absorbing function.

Once the foldlines D such as described above have developed, they would interfere with the flexural deforming movements even after the reduced pressure state has been eliminated by opening the cap. The entire bottom 105 fails to restore its original position from the upward drawing deformation, and as a result, content fluid level fails to drop sufficiently. In this state, a problem is that the content fluid may spill out of the neck when one uncaps a bottle to drink the content fluid.

This invention has been made to solve the above-described problem found in prior art. A technical problem to be solved by this invention is to create a bottom wall structure that enables the bottom to perform a satisfactory vacuum absorbing function when the bottom plate is allowed to draw upward smoothly with the progress of pressure reduction.

Means of Solving the Problems

A main feature of this invention, among the means of solving the above-described technical problem, is a biaxially stretched, blow molded synthetic resin bottle with a bottom comprising a sunken bottom portion, which deforms as it draws upward in a direction of bottle inside at a time when there is a pressure drop inside the bottle, and which comprises a ring groove formed by being successively connected to an inner peripheral edge of a ground contact portion disposed at the foot of an outer peripheral wall of the bottom, a central concave portion formed at a center of the bottom, and a flat ring portion disposed between an inner peripheral edge of the ring groove and the central concave portion, wherein the sunken bottom portion is characterized by comprising a plurality of short slim ribs disposed at several points of the flat ring portion.

The bottle having the above-described feature is intended to perform the vacuum-absorbing function by the deformation of the bottom plate which draws upward when there is a decrease in the pressure inside the bottle. Especially, in the case of a bottle having such a bottom, tiny foldlines would develop at the time when the bottom deforms so as to draw upward, as described above, and these foldlines would be formed in portions having especially thin wall on the boundaries between the ring groove and the flat ring portion. These foldlines serve as resistance to interfere with the flexural deformation movements of the bottom plate that occur when there is a pressure decrease inside the bottle, and thus, they inhibit smooth upward drawing deformation and cause the vacuum absorbing function of the bottle to deteriorate.

In the main feature of this invention, a plurality of short slim ribs are disposed at several points of the flat ring portion. These ribs function as the starting points to promote actively the flexural deformation especially between the ring groove and the flat ring portion, and make it possible for the upward drawing deformation of the bottom plate to proceed smoothly.

Another feature of this invention is that the ribs are disposed on the flat ring portion radially from a center of the bottom. The foldlines develop on the flat ring portion when the bottom plate draws upward with the progress of internal pressure reduction, but their number and positions cannot be forecasted because wall thickness distribution of the bottom plate and progression rate for the decrease in pressure are non-constant, and differ from bottle to bottle. In view of this inability to forecast, a plurality of ribs is disposed in advance radially from the center of the bottom. These ribs serve as the starting points to promote smooth upward drawing movements of the bottom plate, and prevent the foldlines from developing.

Still another feature of this invention is that the number of ribs is a multiple number of 3. Although the number and positions of the foldlines on the flat ring portion are not constant, it has been found from experiences that the number of foldlines is a multiple number of 3 and that in most frequent cases, the foldlines develop at six positions in the flat ring portion. If the ribs in a multiple number of 3, 6, 9, etc., are disposed previously in the flat ring portion, then these ribs would surely prevent the foldlines from developing, and would be able to promote smooth upward drawing movements of the bottom plate, starting from the ribs.

Still another feature of this invention is that neighboring ribs are mutually disposed so as to have an equal central angle. According to this feature, flexural deformation proceeds in a well-balanced way, and the sunken bottom portion can go on with the upward drawing deformation smoothly, since the ribs serving as the starting points of the deformation are equally spaced in the flat ring portion.

Still another feature of this invention is that the ribs have a vertical section of a groove. As the shapes of ribs, there are groove ribs and ridge ribs. Because the flat ring portion is in the bottom in the case of this bottle, groove ribs are adopted so as to be able to give the bottle a self-standing capability.

Effects of the Invention

This invention having the above-described features has the following effects:

According to the main feature of this invention, the ribs formed in the flat ring portion serve as the starting points for the flexural deformation of the bottom when there is a decrease in pressure inside the bottle. Because of this role of the ribs, the bottom plate draws upward smoothly, and enables the bottle to perform fully the vacuum absorbing function. Furthermore, because the upward drawing deformation proceeds smoothly, while preventing the foldlines from developing, the bottle can maintain good outer appearance and a high commodity value.

If the bottle is uncapped and liberated from the reduced pressure state, the entire bottom completely restores its original position from the upward drawing state, and the liquid level goes back to the previous level before the pressure reduction. Therefore, it is easy to avoid the problem that the content fluid may spill out of the neck when one uncaps a bottle to drink the content. Thus, it is possible to increase safety in drinking.

According to the feature of the ribs disposed in the flat ring portion radially from the center of the bottom, the flexural deformation movements starting from the ribs can be made to take place at and near the center of the bottom. The bottom plate can draw upward smoothly, thus allowing the bottle to perform fully the vacuum absorbing function.

According to the feature on the number of ribs defined by a multiple of 3, the foldlines can be prevented reliably from developing in a multiple number of 3, as empirically known to develop at a high rate, and the ribs in this number ensure that the bottom plate draws upward smoothly.

According to the feature of the ribs mutually disposed so as to have an equal central angle, the flexural deformation starting from the ribs can be well balanced evenly as observed from the center of the bottom, and smooth upward drawing movements can be worked out. This is because the ribs, from which the flexural deformation starts, can be disposed in the flat ring portion at equally-spaced intervals.

According to the feature on the ribs having the vertical section of a groove, self-standing property of the bottle can be maintained by the groove, which is a shape suited to practical uses of the bottle.

MODE OF CARRYING OUT THE INVENTION

Figure 1:
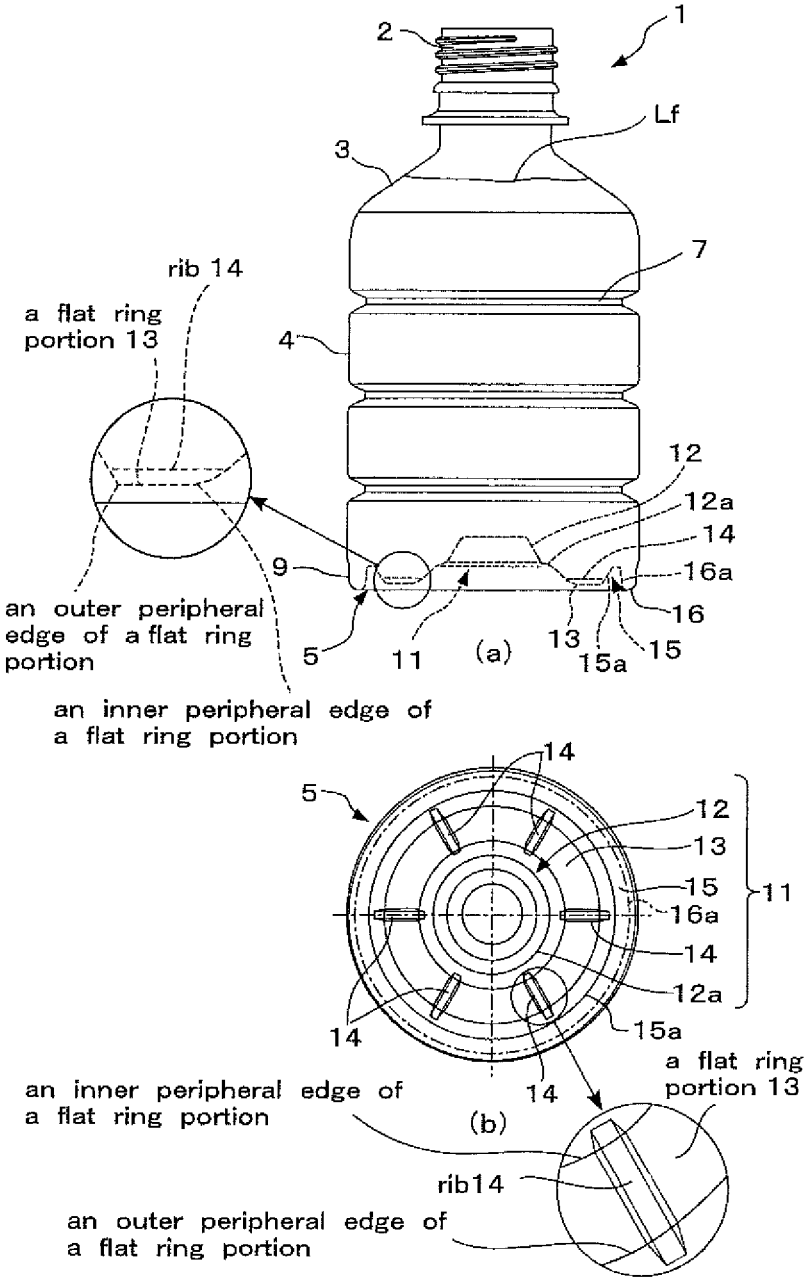
FIG. 1(*a*) is a front view, and FIG. 1(*b*) is a bottom view, of the bottle in an embodiment of this invention.

This invention is further described with respect to a preferred embodiment, now referring to the drawings. FIG. 1(*a*) is a front view, and FIG. 1(*b*) is a bottom view, of the synthetic resin bottle in the embodiment of this invention. The bottle 1 has a neck 2, a shoulder 3, a cylindrical body 4, and a bottom 5, and is a biaxially stretched, blow molded product made of a PET resin having a capacity of 350 ml.

The body 4 has a plurality of peripheral ribs 7 (three ribs in FIG. 1) to increase surface rigidity so that the bottle has a high ability to retain its shape. A heel wall portion 9 is formed in a curved cylindrical shape at a lower end of this body 4. This heel wall portion 9 has a peripheral ground contact portion 16 on the underside. The bottom 5 is connected to the body 4 by way of this heel wall portion 9, which is disposed in an outermost peripheral area of the bottom 5.

A sunken bottom portion 11 is formed in the bottom 5. Starting from an unmoving end 16*a* disposed at an inner peripheral edge of the ground contact portion 16, the bottom plate of the bottle 1 is undulated and concaved upward in a direction of bottle inside. When internal pressure goes down, the sunken bottom portion 11 further draws upward from the state shown in FIG. 1, so that this portion would be able to perform the vacuum absorbing function (See FIG. 2). The unmoving end 16*a* is a part of the inner peripheral end of the ground contact portion 16, and serves as a base end, which hardly deforms in the radial direction even when the sunken bottom portion 11 undergoes upward drawing deformation, or is quite less deformable even if this unmoving end deforms.

The sunken bottom portion 11 described above comprises a ring groove 15 having a vertical section in an inverted U-letter shape, which extends toward the inside of the bottle 1, starting from the unmoving end 16*a* of the inner peripheral wall of the ground contact portion 16; a central concave portion 12 disposed at a center of the bottom; and a flat ring portion 13, which connects the inner peripheral edge 15*a* of the ring groove 15 to a lower end of a stepped portion 12*a* disposed at the base of the central concave portion 12.

As shown in FIG. 1(*b*), short slim ribs 14 are formed at several points in the flat ring portion 13. The ribs 14 have a vertical section in a shape that is caved in toward the inside of the bottle 1. An outermost end of each rib 14 is located near the inner peripheral edge 15*a* of the ring groove 15, and an innermost end thereof is located near a lower end of the stepped portion 12*a*. These ribs are formed in a state in which the radial direction is in alignment with the longitudinal direction, i.e., in a state radially disposed from the center of the bottom 5.

Figure 2:
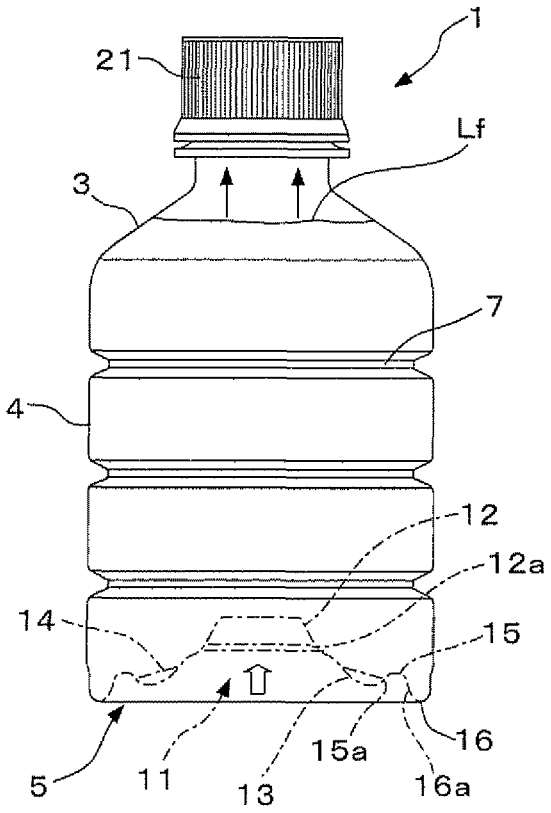
FIG. 2 is a front view of the bottle of FIG. 1 showing a pattern of deformation in the bottom plate observed during the time of a pressure decrease inside the bottle.
Figure 3:
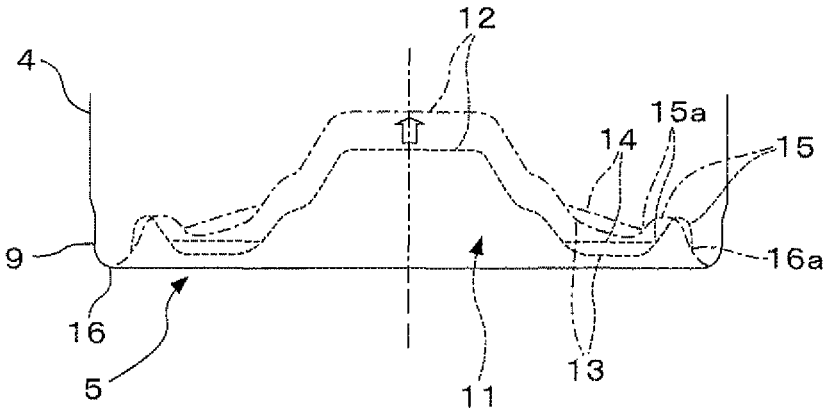
FIG. 3 is an enlarged vertical section of the bottle of FIG. 1 showing the bottom and neighborhood.
Figure 4:
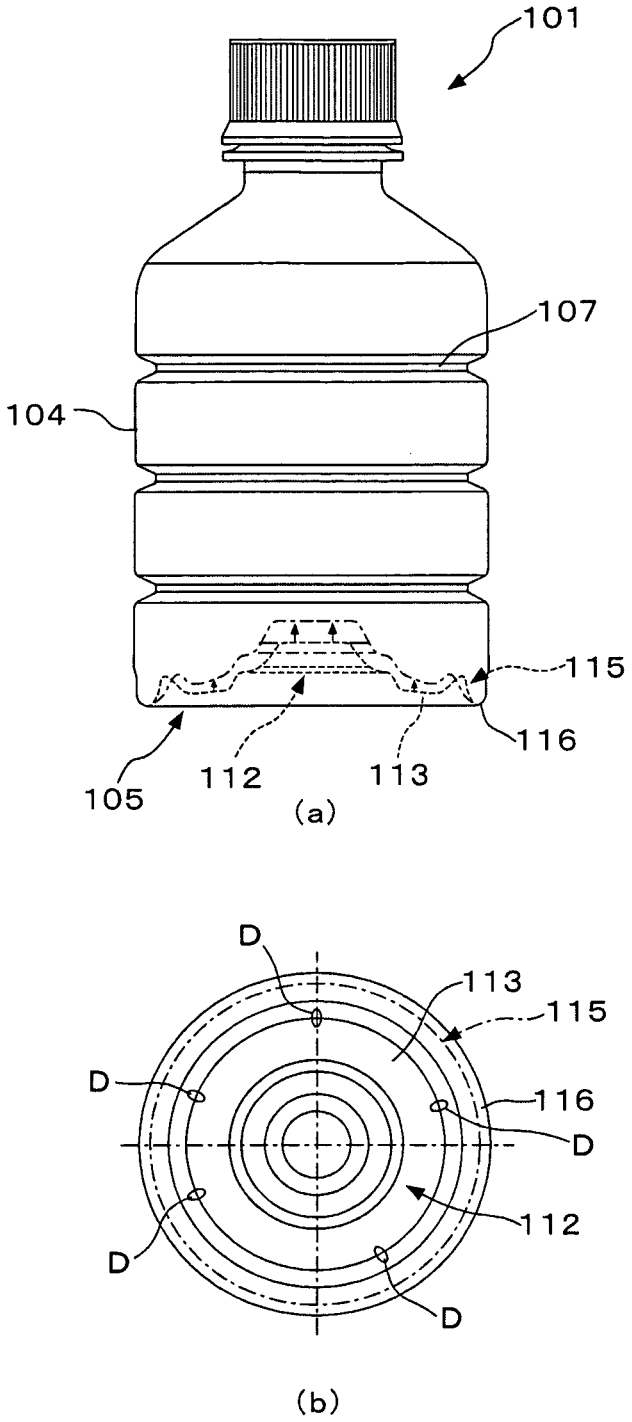
FIG. 4(*a*) is a front view, and FIG. 4(*b*) is a bottom view, of a bottle in prior art.

FIG. 2 is a front view of the bottle 1 of FIG. 1, which has been hot filled with a content fluid and sealed by a cap 21. This view shows that the sunken bottom portion 11 has drawn upward when there was a decrease in the pressure inside the bottle 1. FIG. 3 is an enlarged vertical section of the bottle of FIGS. 1 and 2 showing the bottom and neighborhood of the bottle. In FIG. 3, the broken line indicates the state of the bottom before deformation caused by the decrease in internal pressure; and the dashed-dotted line indicates the state of the bottom during the deformation caused by the decrease in internal pressure.

When the bottle 1 is hot filled with a content fluid and sealed by the cap 21, the sunken bottom portion 11 deforms from the state before the pressure drop, as shown in broken lines in FIGS. 1 and 3, to the state under ongoing pressure drop, as shown in the dashed-dotted lines in FIGS. 2 and 3. During this deformation, the ring groove 15 and the flat ring portion 13 draw upward in the direction of the inside of the bottle 1. Consequently, the entire sunken bottom portion 11 including the central concave portion 12 draws upward in the direction of bottle inside, as shown by an outlined arrow, to perform the vacuum absorbing function. At that time, the deformation of the sunken bottom portion 11 makes the liquid level Lf go up to a height position just under the lower end of the neck 2.

It should be noted here that when the sunken bottom portion 11 deforms so as to draw upward, the bottom plate undergoes flexural deformation in the direction of the inside of the bottle 1. In more details, the inner peripheral edge 15*a* of the ring groove 15 deforms in the direction of the inside of the bottle 1, using the unmoving end 16*a* as the base end. Then, the flat ring portion 13 and the central concave portion 12 draw upward successively in the direction of the inside of the bottle 1. At that time, the flexural deformation goes on, starting from the ribs 14 formed in the flat ring portion 13. Therefore, the bottom plate draws upward smoothly. The foldlines are prevented from developing, and the sunken bottom portion 11 draws upward reliably, thus allowing the bottle 1 to perform the vacuum absorbing function successfully.

When the cap 21 is opened from the state shown in FIG. 2 and the inside of the bottle 1 returns to normal pressure from the reduced pressure condition, the bottom plate of the bottom 5 restores its original state due to the elastic deforming action of the bottom plate. At that time, since the flat ring portion 13 and the ring groove 15, too, restore their original state, the sunken bottom portion 11 draws downward to its original state, thus allowing the liquid level Lf to go down to its original level. Therefore, when the cap 21 is opened, and the reduced pressure condition is resolved, it is possible to avoid the trouble that the content fluid may spill out because the liquid level Lf fails to go down.

In this embodiment, the ribs 14 are disposed radially at six positions in the flat ring portion 13. Because the ribs 14 are disposed in the flat ring portion 13 radially from the center of the bottom 5, the upward drawing movements can proceed smoothly because the points at which flexural deformation starts are disposed around the center of the bottom 5. In addition, the ribs 14 can prevent the foldlines from developing and interfering with the smooth upward drawing movements.

Furthermore, it is preferred to dispose the multiple ribs 14 so as to have the same distance or central angle between two neighboring ribs 14. In such a layout, the starting points for flexural deformation can be disposed equally around the center of the bottom 5, and therefore, the flexural deformation can proceed smoothly in a well-balanced way. As a result, the vacuum absorbing function is upgraded.

The above preferred embodiment has been described as having the ribs 14 disposed at six positions. However, this invention should not be construed as limitative to this embodiment. It is found from experiences that the foldlines are formed over the ring groove 15 in a multiple of 3, such as 3, 6, 9, and the like. Therefore, preferably, the ribs, too, are formed in a multiple of 3. In such a rib structure, the ribs 14 can be used as the starting points for the flexural deformation to start at a high level of probability. Thus, the ribs 14 would be able to contribute to smooth progress of the upward drawing deformation and satisfactory performance of the vacuum absorbing function.

This invention has been described with respect to its features and action-and-effects, referring to the preferred embodiment. However, the mode of carrying out this invention is not limited to the above-described embodiment.

INDUSTRIAL APPLICABILITY

The synthetic resin bottle of this invention makes the bottom perform the vacuum absorbing function with no vacuum absorbing panels formed on the body. The bottle has a bottom plate structure in which the bottom plate can fully recover from the state of upward drawing deformation that takes place with a pressure drop inside the bottle. The bottle can be reliably utilized, and is expected to have wider applications of use in the field of bottles requiring hot filling.

DESCRIPTION OF REFERENCE SIGNS

1. Bottle
2. Neck

3. Shoulder
4. Body
5. Bottom
9. Heel wall portion
11. Sunken bottom portion
12. Central concave portion
12*a*. Stepped portion
13. Flat ring portion
14. Rib
15. Ring groove
15*a*. Inner peripheral edge of the ring groove
16. Ground contact portion
16*a*. Unmoving end
21. Cap
Lf. Liquid level

The invention claimed is:

1. A biaxially stretched, blow molded synthetic resin bottle with a bottom comprising a sunken bottom portion, which deforms as it draws upward in a direction of bottle inside at a time when there is a pressure drop inside the bottle, and which comprises:

a ring groove formed integrally with an outer peripheral wall anchored to an unmoving inner peripheral end of a ground contact portion disposed at the foot of an outer peripheral wall of the bottom, a central concave portion disposed at a center of the bottom, and a flat ring portion that is formed between an inner peripheral edge, of the ring groove, as viewed in cross-section, and a lower end of a stepped portion of the central concave portion, the flat ring portion projecting downward, and which allows the concave portion to draw upward at the time of a pressure drop while being anchored to the unmoving inner peripheral end so that an entire bottom plate of the bottom deforms into a risen state toward the bottle inside, and a plurality of short, slim, dented ribs disposed on the flat ring portion, with an outermost end of each rib located nearer the inner peripheral edge, of the ring groove, as viewed in cross-section, and an innermost end of each rib located nearer a lower end of the stepped portion, in such a way that a dent would have a same width and a same depth over a length between an outer peripheral edge of the flat ring portion and the inner peripheral edge of the flat ring portion, as viewed in cross-section, wherein the ribs are starting points for deformation when the bottom draws upward.

2. The synthetic resin bottle according to claim 1, wherein the ribs are formed in the flat ring portion and are disposed radially from the center of the bottom.

3. The synthetic resin bottle according to claim 1, wherein the number of ribs is a multiple number of 3.

4. The synthetic resin bottle according to claim 1, wherein neighboring ribs are mutually disposed so as to have an equal central angle.

5. The synthetic resin bottle according to claim 2, wherein the number of ribs is a multiple number of 3.

6. The synthetic resin bottle according to claim 2, wherein neighboring ribs are mutually disposed so as to have an equal central angle.

7. The synthetic resin bottle according to claim 3, wherein neighboring ribs are mutually disposed so as to have an equal central angle.

8. The synthetic resin bottle according to claim 5, wherein neighboring ribs are mutually disposed so as to have an equal central angle.

* * * * *